US008096255B2

(12) United States Patent
Morand et al.

(10) Patent No.: US 8,096,255 B2
(45) Date of Patent: Jan. 17, 2012

(54) SHIP WITH STERN EQUIPPED WITH A DEVICE FOR DEFLECTING A FLOW OF WATER

(75) Inventors: Loïc Morand, Pornichet (FR); Gervais Chardin, Pornichet (FR); Jean-Pierre Collin, Saint Nazaire (FR)

(73) Assignee: STX France Cruise SA, Saint Nazaire (FR)

( * ) Notice: Subject to any disclaimer, the term of this patent is extended or adjusted under 35 U.S.C. 154(b) by 248 days.

(21) Appl. No.: 12/498,832

(22) Filed: Jul. 7, 2009

(65) Prior Publication Data

US 2010/0000462 A1 Jan. 7, 2010

(30) Foreign Application Priority Data

Jul. 7, 2008 (FR) ..... 08 54601

(51) Int. Cl.
*B63B 1/22* (2006.01)

(52) U.S. Cl. ..... 114/285

(58) Field of Classification Search ..... 114/271, 114/284, 285, 286
See application file for complete search history.

(56) References Cited

U.S. PATENT DOCUMENTS

| | | | | |
|---|---|---|---|---|
| 3,463,109 | A | 8/1969 | Weiler | |
| 4,896,622 | A | 1/1990 | Thomas | |
| 4,909,175 | A * | 3/1990 | Arnseson | 114/285 |
| 5,383,419 | A | 1/1995 | Stevens | |
| 6,038,995 | A | 3/2000 | Karafiath et al. | |
| 7,216,601 | B1 * | 5/2007 | Mann | 114/285 |

FOREIGN PATENT DOCUMENTS

| | | |
|---|---|---|
| DE | 197 53 926 | 5/1999 |
| DE | 198 37 888 | 2/2000 |
| EP | 0 518 229 | 12/1992 |
| WO | WO 98/24684 | 6/1998 |

* cited by examiner

*Primary Examiner* — Lars A Olson
(74) *Attorney, Agent, or Firm* — Pauley Petersen & Erickson

(57) ABSTRACT

The device comprises a plurality of deflector members (1) having a submerged lower face (2), called first face, generally fitting into the extension of the hull bottom (FC) of the ship, toward the rear thereof, while forming an angle (α) in relation to a general plane (Δ) tangent to this bottom (FC), characterized by the fact that these deflector members (1) are articulated to the hull and are juxtaposed side by side, over all, or practically all, the width of the stern, control means (4) making it possible to cause it to pivot in one direction or the other in order to vary said angle (α), these means being housed in part in a protective case.

17 Claims, 7 Drawing Sheets

SHIP WITH STERN EQUIPPED WITH A DEVICE FOR DEFLECTING A FLOW OF WATER

BACKGROUND OF THE INVENTION

1. Field of the Invention

The present invention concerns a ship whereof the stern is equipped with a device for deflecting a flow of water.

It more particularly concerns a ship with large dimensions and a high tonnage, such as a cruise ship in particular, the displacement speed of which is relatively limited in relation to that of light and fast boats, this speed being between 10 and 25 knots or approximately between 18 and 45 km/h in cruising speed, for information, and the Froude number of which does not exceed 0.28.

2. Discussion of Related Art

It is known to equip the hull of a ship of this type with a deflector member in wedge form, positioned below the waterline, in the connection zone of the bottom of the hull with the rear flank—or bow—of the ship.

The function of a deflector of this type, generally designated by the expression "trim wedge", is to deviate, downward and rearward, the flow of water in relative movement, which passes under the hull, at the stern, which results in increasing the power of the ship or, correlatively, by decreasing the fuel consumption necessary for its propulsion for a given speed.

A deflector of this type is described in patent U.S. Pat. No. 6,038,995, for example.

One drawback of the known deflectors is that their efficiency, in particular regarding power gains provided, depends on the trim of the ship (which can depend on its load and/or navigation conditions), as well as the ship's speed.

The dimensions and the angle of the "wedge" making up the deflector, which are determined in order to ensure maximum effectiveness under certain given trim and speed conditions, are therefore not necessarily optimal under other conditions.

Already known from document WO-98/24684 is a small fast motor vessel, provided at its rear end with two pivoting float bodies, arranged on either side of the propulsion means of the boat.

These float bodies are deployed downwardly, when the boat moves at a low speed, so as to lift the rear of the boat, cause it to squat (passage into plane mode) and thereby decrease the shoulder wave at the front of the ship.

At high speed, the float bodies are on the contrary in the withdrawn position.

This type of arrangement of the hull is not, however, applicable to a ship with large dimensions and high tonnage, which does not squat. Moreover, it does not make it possible to avoid the recirculation of the wave at the rear of the ship, whereas this phenomenon is the source of a loss of propulsive energy for the ship (through increased friction and disruption of the flow in the vicinity of the blades of the propulsive means).

Moreover, this type of float body does not make it possible to resolve the problem of rear slamming, as the surge coming from the rear can freely penetrate under the rear counter, in the central zone of the boat which extends between the two float bodies.

SUMMARY OF THE INVENTION

The invention aims to resolve the aforementioned difficulties.

The object of the invention is therefore a ship with large dimensions and high tonnage, such as a cruise ship in particular, the stem of which is equipped with a device for deflecting flows of water, comprising several deflector members having a submerged lower face, called first face, fitting overall into the extension of the bottom of the hull, toward the rear thereof, while forming an angle in relation to a general plane tangent to this bottom, each of these deflector members being articulated to the hull, control means making it possible to cause it to pivot in one direction or the other in order to cause said angle to vary.

According to the invention, on one hand, these deflector members are similar and juxtaposed such that they extend transversely side by side, over all, or nearly all, the width of the stem, each of them consisting of a case and, on the other hand, said means for controlling the pivoting of each deflector member comprise at least one hydraulic jack, the body of which is housed in a protective case integral with the structure of the hull and the rod of which is inserted between the rear portion of the hull and case for which it controls the pivoting, such that this jack is sheltered from the surge and from waves.

In this way the value of the angle can be modified, either voluntarily by actuating an ad hoc maneuvering member, or automatically according to certain parameters, such as the speed and trim of the ship in particular.

Moreover, the arrangement of the deflector members over all or nearly all of the width of the stem makes it possible to smooth the wave at the rear of the ship and to avoid the phenomenon of recirculation of the wave, which is a source of wasted energy.

Moreover, according to a certain number of possible additional characteristics of the invention:

- each case is closed on the top by walls turned upward and forward, respectively, forming a dihedron, and is closed on the sides by lateral vertical walls, said hydraulic jack being inserted between the stem structure of the ship and the angular zone of this dihedron, such that it is isolated in a relatively enclosed space in the upper part of the dihedron;
- said control means make it possible to vary said angle within a range comprised between a negative value, corresponding to an orientation of said first face inclined upward and rearward in relation to said general plane, and a positive value, corresponding to an orientation of this first face downward and rearward in relation to this general plane;
- said control means comprise a set of hydraulic jacks working synchronously;
- these hydraulic jacks are controlled voluntarily by actuating a maneuvering member;
- these hydraulic jacks are controlled by a shuttle valve, subjugated to the speed and/or trim of the ship;
- each of said deflector members in case form has a rear face or second face, also submerged at least partially, able to be lowered by increasing said aforementioned angle, so as to form an approximately vertical wall opposing slamming by rear surge;
- said first surface is substantially flat;
- said first face is made up of two substantially flat front and rear facets which form an obtuse angle dihedron open downwardly;
- said second face is substantially flat;
- said second face is made up of two substantially flat upper and lower facets which form an obtuse angle dihedron open toward the rear;
- the set of deflector members has a shared pivot axis;

the pivoting of the set of deflector members is done jointly, over a same angle, using said pivot control means;

the pivoting of the various deflector members is done in a differentiated manner, with different angle values, using said pivot control means;

the stern of the ship is provided with a spoiler serving as shield able to protect the deflector member as well as the hydraulic jacks from the assault of the surge and waves coming from the rear.

It should be noted that the expression "shared pivot axis" used above does not necessarily refer to a shared shaft, this shared axis being able to take the form of separate, but coaxial shaft sections.

Other characteristics and advantages of the invention will appear upon reading the following description of one preferred embodiment of the invention.

BRIEF DESCRIPTION OF THE DRAWINGS

This description is done in reference to the appended drawings, in which.

DESCRIPTION OF PREFERRED EMBODIMENTS

Figure 1:
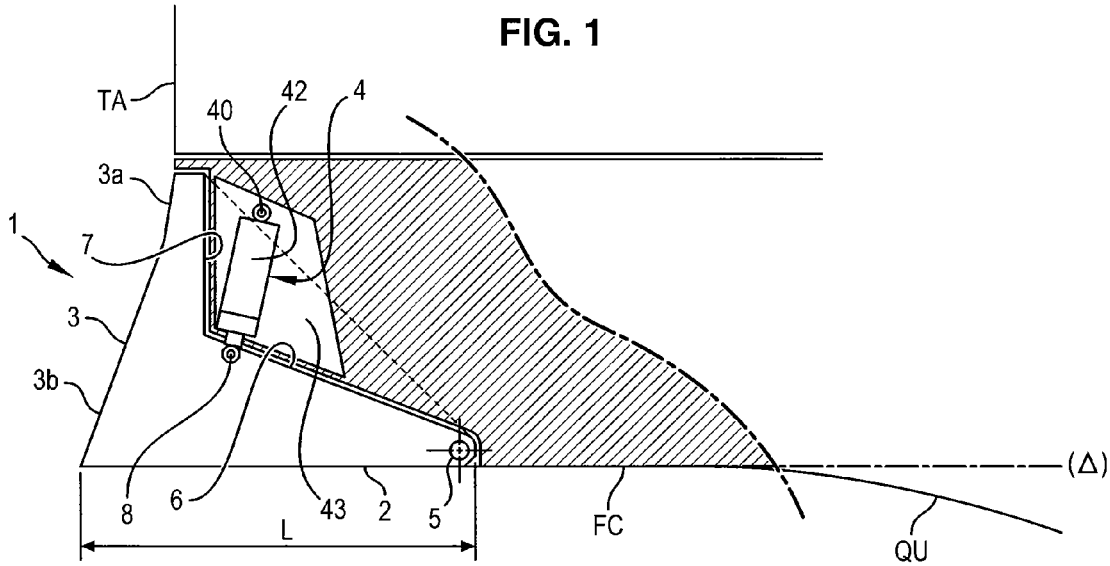
FIG. 1 is a diagrammatic side view (starboard side) of a first embodiment of a device constituting the invention, the deflector member of which is in the retracted, inactive position.
Figure 2:
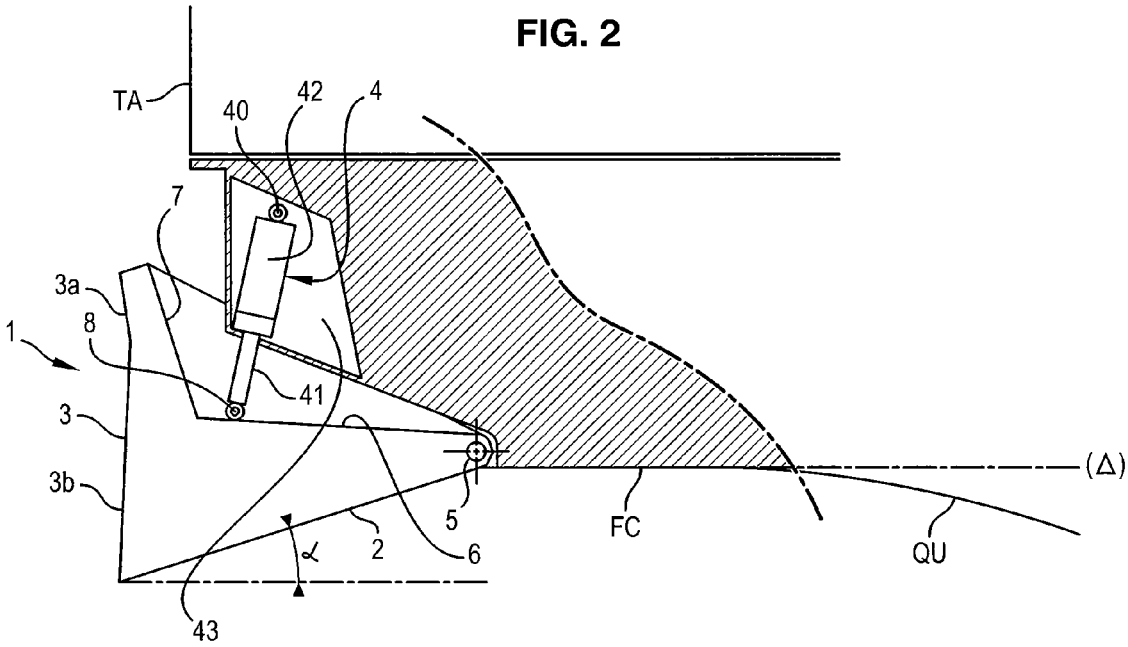
FIG. 2 is a view similar to that of FIG. 1 showing the deflector member in the active position, folded downward.

In reference to FIGS. 1 and 2, the reference 1 designates a deflector member arranged at the rear of a ship with large dimensions and high tonnage, such as a cruise ship, for example.

The reference FC designates the hull bottom, relatively flat, QU designates the rear portion of the keel, and TA designates the rear table of the stem.

The front of the ship is located on the right side of these figures.

The reference Δ corresponds to a plane in which the hull bottom FC fits overall at the level of the vertical cutting plane corresponding to FIGS. 1 and 2.

The deflector member 1 essentially comprises two walls in the form of functional faces 2 and 3.

The first face 2 is approximately flat (except for its slight transverse curve, visible in FIG. 3), and turned downward.

Purely for information, its longitudinal dimension, referenced L in FIG. 1, is between approximately 4 and 5 meters.

The second face 3 is turned toward the rear. It is made up of two facets, an upper one 3*a* and a lower one 3*b*, which form a dihedron with a horizontal and transverse edge, the apex angle of which is an obtuse angle open toward the rear, with a high value, for example in the vicinity of 160°. The facet 3*b* extends over a much greater height than the facet 3*a*.

The face 2 and the facet 3*b* are also substantially in the shape of a dihedron with a horizontal and transverse edge, but the apex angle of which is an acute angle open toward the front and top. For information, its value is in the vicinity of 70°.

The deflector member 1 is a hollow case, which is closed on the top by walls 6 and 7 turned upward and frontward, respectively, and which also form a dihedron, with an obtuse angle open upward and frontward. On the sides, this case is closed by vertical lateral walls (not visible in the figures).

The different walls making up the case are, for example, stainless steel sheets welded to each other; the case can be reinforced by internal frames (not shown) such as ribs and partitions, in order to suitably resist hydrodynamic stresses and reduce deformations.

The case is sealed and air filled.

This case thus has an approximately L-shaped profile and—according to an important characteristic of the invention—it is articulated toward the front, in the end portion of its horizontal branch, around a shaft 5 with a horizontal and transverse axis.

This shaft is integral with the hull.

The pivoting of the deflector member 1 is realized using at least one hydraulic jack 4 and, advantageously, a set of parallel hydraulic jacks, for example three (only one of which is visible in the figures), which work jointly and synchronously.

These may, for example, be double-acting jacks, the body 42 of which is integral, via a hinged connection 40, with the stem structure of the ship, and the rod 41 of which is integral, via a hinged connection 8, with the deflector case 1. In the illustrated embodiment, this connection 8 is positioned in the angular connection zone of the walls 6 and 7.

Figure 3:
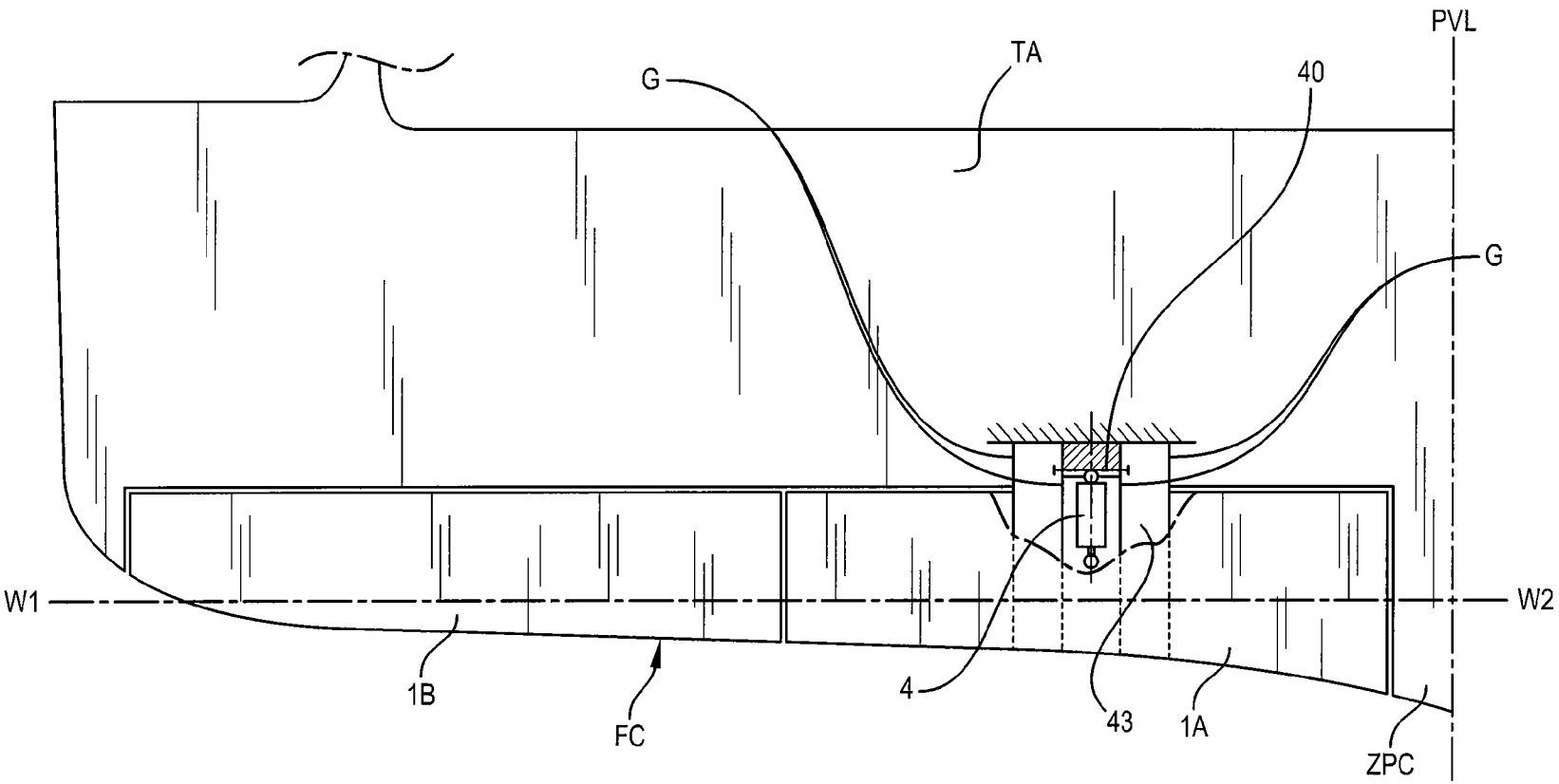
FIG. 3 is a diagrammatic end view of the rear, of a stern half-bow (port side) of a ship equipped with a device according to the invention, comprising four juxtaposed deflector members, two of which are visible in the half-view, these deflectors being shown in the retracted, inactive position.

The connection 40 advantageously consists of a horizontal and transverse trunnion mounted between two longitudinal and vertical brackets G of the stem structure of the ship, as shown by the partial and diagrammatic cross-section of FIG. 3.

When the jacks 4 are retracted, the face 2 fits substantially into the aforementioned plane Δ, in the extension of the hull bottom. One will note that the jacks 4 are then isolated in a relatively enclosed space, between the rear portion of the hull and the upper portion of the dihedron formed by the walls 6 and 7 of the case. They are then sheltered, protected from shocks due to the surge and waves.

Moreover, each jack 4 is advantageously housed in a protective case 43 integral with the hull structure, and arranged behind it. This case 43 is defined for example by a pair of brackets G.

When they are extended, the face 2 forms an acute angle α with the plane Δ, the value of this angle depending on the degree of extension of the cylinder rods 41.

It should be noted that when the deflector member 1 is moved from an active position (FIG. 2) toward its idle position (FIG. 1), the water which may have settled in the recess of the dihedron defined by the walls 6 and 7 can flow freely toward the front along the wall 6, which assumes an inclined position.

In reference to FIG. 3, we have shown a device comprising several juxtaposed similar deflector members, extending transversely side by side, over all, or nearly all, the width of the hull.

More precisely, the ship is equipped with four deflector members, distributed in two pairs arranged symmetrically on either side of the median longitudinal vertical plane PVL of the ship.

In the illustrated example, a relatively narrow central zone ZPC of the stem is kept, without deflector members.

On each side of this zone are mounted two juxtaposed deflectors 1A and 1B, the structure of which is similar to that of the member 1 previously described. Their lower edge is profiled, with a contour which corresponds substantially to that of the lower edge of the hull bottom, such that there is not, or practically is not, any disappearance of the continuity between the hull bottom and the lower face of the deflector member.

Reference W1-W2 designates the horizontal and transverse axis of articulation which is shared here by the two cases 1A and 1B (axis in the form of the shaft 5 in FIGS. 1 and 2).

Each case is actuated using a set of three jacks 4 which are regularly distributed on its length.

The three jacks of a same set (allocated to the same deflector) are controlled so as to work synchronously, with the same degree of extension or retraction.

Figure 4:
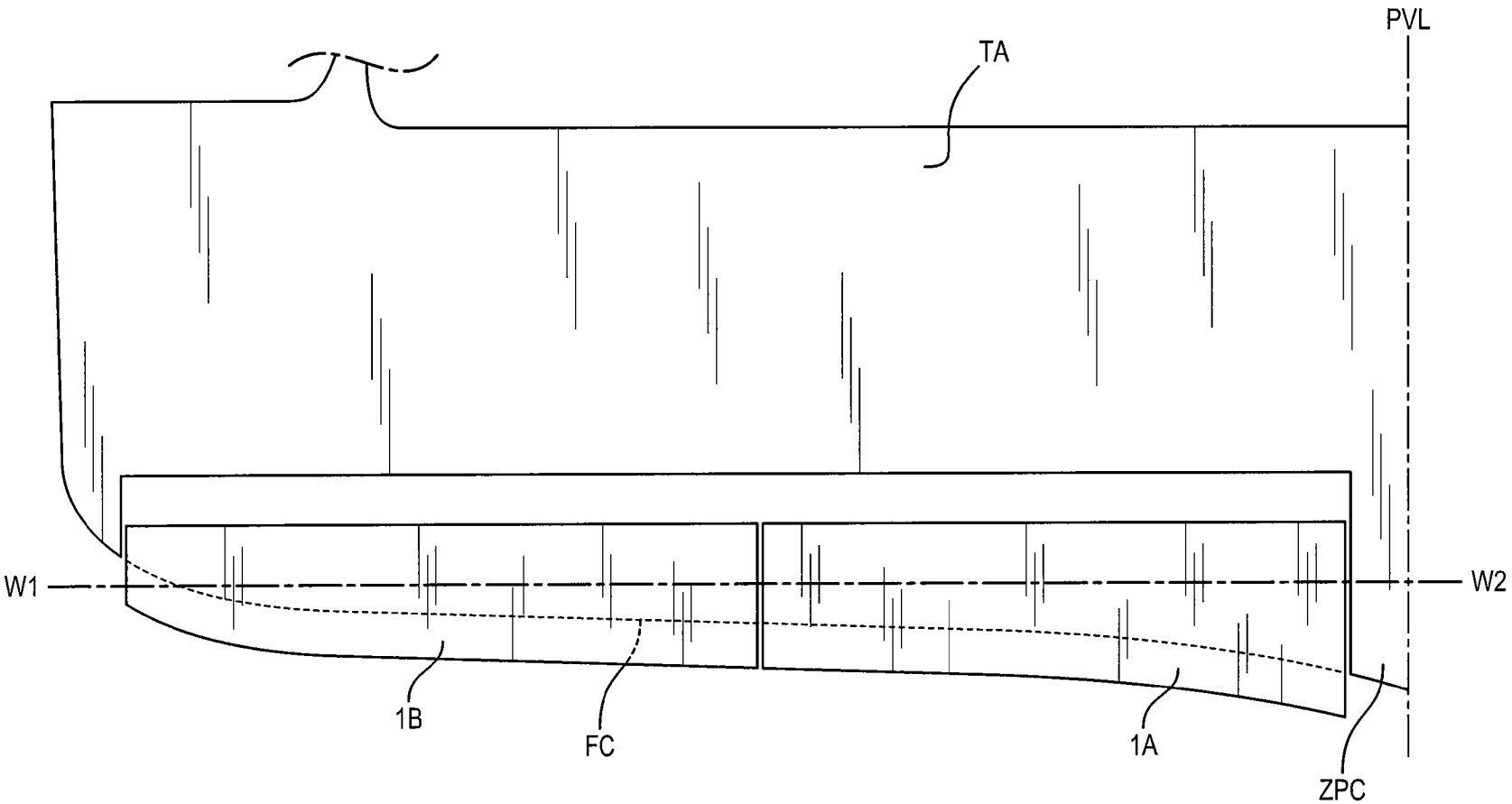
FIG. 4 is a view similar to that of FIG. 3, showing the juxtaposed deflector members, these deflectors being in the active position, folded downward.

FIG. 4 illustrates a situation in which the two sets of jacks also work synchronously, such that the pivot angle of the two cases 1A, 1B (and correlatively the travel of their lowering, visible in this figure) is the same.

Figure 5:
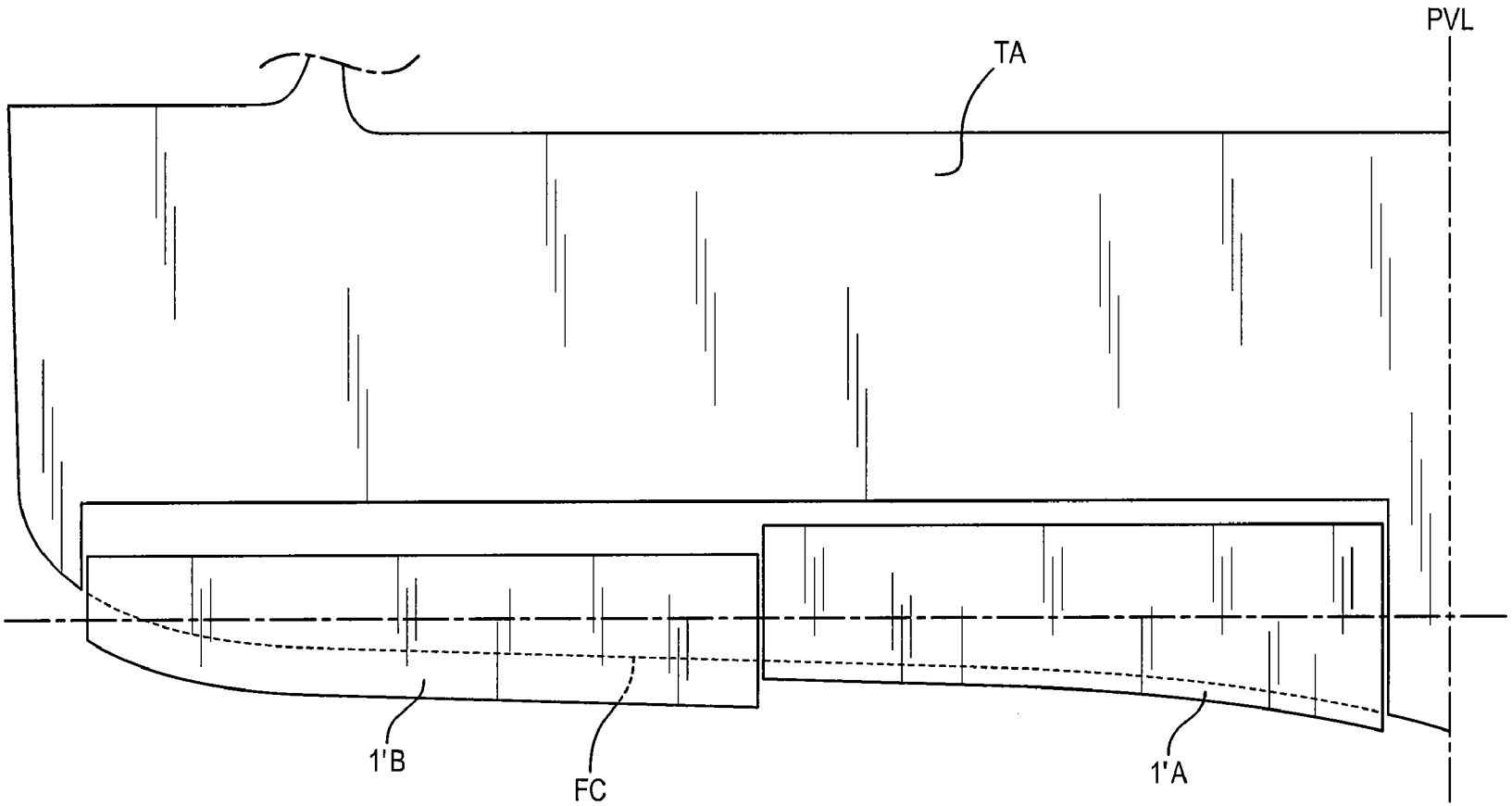
FIG. 5 is similar to FIG. 4, but with deflector members positioned in different angular positions.

FIG. 5 illustrates a different situation in which the two sets of jacks are piloted independently, the pivot angle of the two cases 1A, 1B being different; in this case the travel for lowering of the outer deflector, designated 1'B, is greater than that of the inner deflector, designated 1'A. The opposite is also possible.

Figure 7:
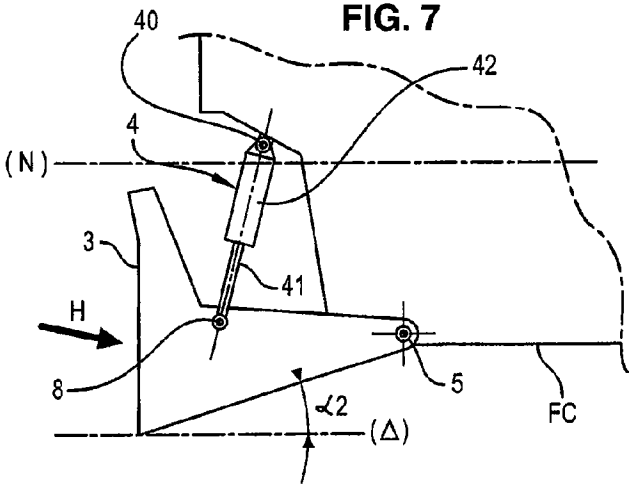
FIGS. 6 and 7 are diagrams similar to those of FIGS. 1 and 2, illustrating angular positions of the deflector which are adapted respectively to "deflection of water" and "anti-slamming" functions.
Figure 6:
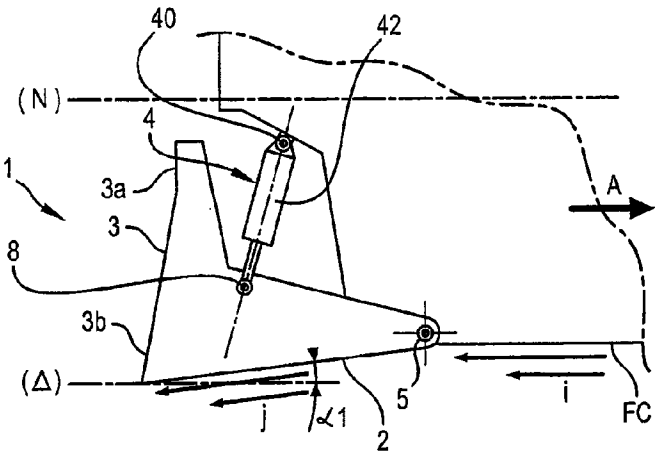

In reference to FIGS. 6 and 7, we will now explain how such a deflector device is used to ensure smoothing of the rear wave or an "anti-slamming" function, respectively.

The waterline bears the reference N.

FIG. 6 illustrates a situation of ordinary navigation, the progress of the ship being symbolized by the arrow A.

The degree of extension of the jacks 4 is moderate, such that the angle $\alpha$1 formed by the face 2 of the deflector with the plane $\Delta$ is relatively small, for example approximately 3°.

As a result of the incline of said face 2, the channels of water i which pass under the hull in motion are deviated downward and rearward, as symbolized by the arrows j, which results in avoiding recirculation of the wave at the rear, causing an increase in the power developed for propulsion and, correlatively, a decrease in fuel consumption at a given speed.

However, it has been observed that an optimal angle value $\alpha$1 for a given speed, for example 23 knots, can be unfavorable for a different speed, for example 18 knots.

Other parameters, in particular the trim of the ship (which can depend on its loading as well as navigation conditions), the direction of the wind and sea currents, and the surge, can have a negative impact on the effectiveness of the device for this given angle $\alpha$1.

This is why, thanks to the invention, it is possible to modify this angle by actuating the hydraulic jacks 4 in one direction or the other in order to vary the angular position of some or all of the deflector members which equip the ship so as to continuously optimize the angle $\alpha$.

Each deflector member can be maintained in position using a shuttle valve.

The jacks can be controlled manually, or preferably automatically, via a calculation and control unit which receives signals, from ad hoc sensors, relative to the relevant parameters which must be taken into account: speed and trim in particular. This unit actuates the jacks in real time so as to optimize the effect of the device.

For information, the range of the values of angle $\alpha$ implemented is between 0 and 6°.

In practice, when the ship moves at a low speed, the phenomenon of recirculation of the wave at the rear is negligible and in this case, the jacks 4 are actuated (retracted) such that the deflector elements 1 are in the idle position (FIG. 1).

On the contrary, when the ship moves at a high speed, for example above 15 knots (27 km/h) for a ship 300 m long, the jacks 4 are actuated (deployed downward, see FIG. 2). In this position, they make it possible to avoid recirculation of the wave at the rear, limit eddies, and thereby avoid a loss of the propulsive force of the ship.

FIG. 7 illustrates an anti-slamming situation, the arrow H symbolizing a rear surge.

When a large ship which is stopped (docked at a port, for example) or navigating at low speed is exposed to a surge from the rear, it is common for the flow of water generated by this surge to penetrate under the rear counter, in the junction zone of the hull bottom with the stern bow.

In this phenomenon, usually called "slamming", the impact of the water is likely to cause violent shocks, with vertical components causing undesirable oscillations and vibrations which spread in the entire structure of the ship and are sources of discomfort for passengers and irritations for mechanical maintenance of the structure.

The invention also makes it possible to resolve this problem.

To this end, the jacks 4 are significantly, even fully extended, such that the aforementioned angle $\alpha$—designated $\alpha$2 in FIG. 7—has a value such that the rear face 3 of the deflector member 1 is upright, in an approximately vertical position.

In the illustrated embodiment, the value of the angle $\alpha$2 is in the vicinity of 20° so that this is the case.

In this type of situation, the surge H cannot penetrate under the stem "counter", mentioned above, to create impacts against the hull bottom FC, as is easily understood from looking at FIG. 7.

The flow of wavy water due to the surge is blocked by the rear dorsal face 3 of the deflector member 1.

Actuating the set of jacks 4 of the device, or only some of them, in this anti-slamming position can be controlled voluntarily, depending on atmospheric conditions, or—preferably—automatically by detection of the orientation and amplitude of the surge.

Figure 8:
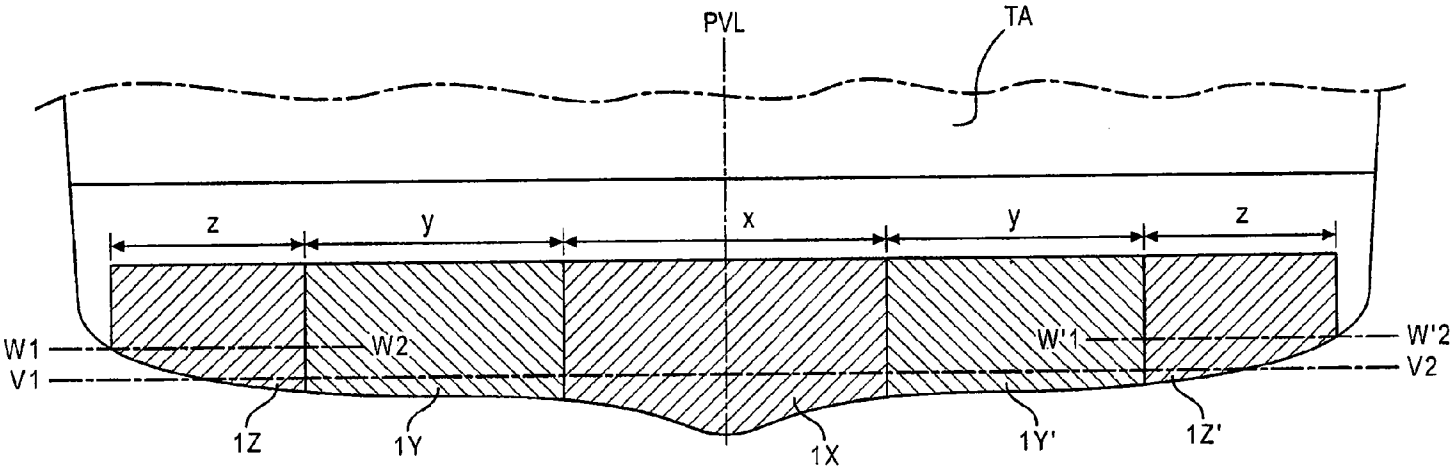
FIG. 8 is a diagrammatic end view of the rear of a stem bow of a ship equipped with a device according to the invention, comprising five juxtaposed deflector members, shown in the retracted, inactive position, some of these deflectors having an axis of articulation different from that of the others.

In the embodiment illustrated in FIG. 8, the stem of the ship is equipped with a set of five deflector members, a central one 1X with a transverse dimension—width—"x", two internal lateral ones 1Y and 1Y' with a width "y", and two external lateral ones 1Z and 1Z' with a width "z", arranged symmetrically in relation to the median plane PVL, with x>y>z.

The deflector members 1X, 1Y and 1Y' are provided with a single axis of articulation V1-V2.

On the contrary, the axes of articulation W1-W2 and W'1-W'2 of the deflector members 1Z and 1Z', coaxial to each other, are offset in height in relation to V1-V2, being positioned above the latter.

This arrangement shows that there are a plurality of possible arrangements concerning the number of deflector members, their width, the positioning of their pivot axis (individual or collective), as well as their control, whether individual or grouped together.

In the second and third embodiments illustrated in FIGS. 9-10 and 11-12, which are variations of the embodiment illustrated in FIGS. 1 and 2, the same reference signs have been used to illustrate elements identical or similar to those already described.

Figure 9:
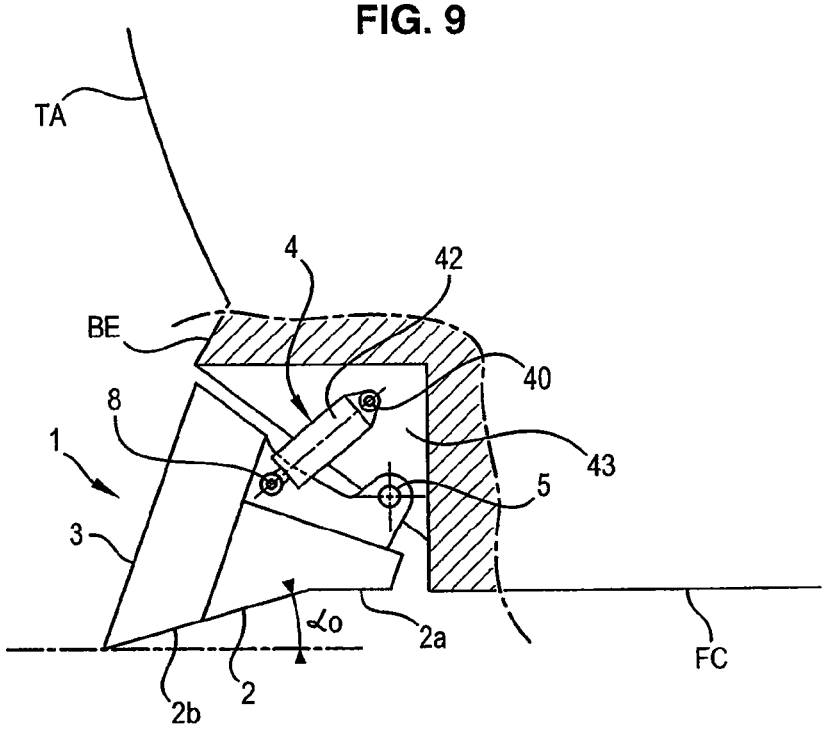
FIGS. 9 and 10 are views similar to those of FIGS. 1 and 2, respectively, showing a second embodiment of the device.
Figure 10:
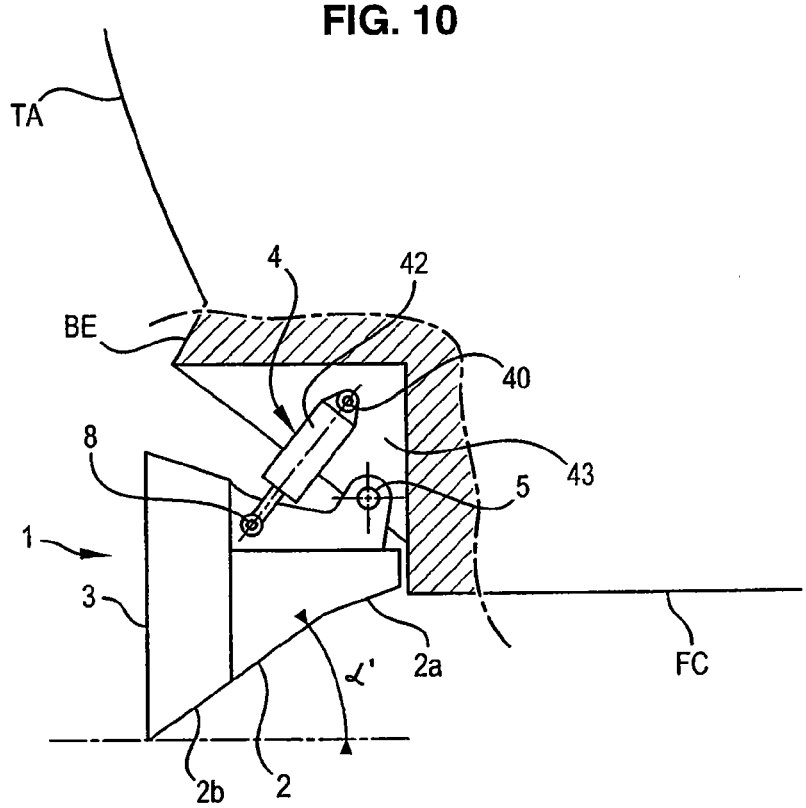

The deflector member 1 of FIGS. 9 and 10 has a first face 2 made up of two contiguous front facets 2*a* and rear facets 2*b* forming a dihedron with an obtuse angle, open downwardly; the second face 3 is flat.

Thus, when this deflector member 1 occupies its idle position as in FIG. 9, the facet 2*b* forms a non null angle $\alpha_0$, which is positive, in relation to the plane of the hull bottom FC.

This angle increases according to the extension of the jacks 4 (angle $\alpha'>\alpha_0$ in FIG. 10).

One will also note, in this embodiment, that:

a) the pivot axis 5 of the deflector member 1 is upwardly offset in relation to the front end portion of this member;

b) the base of the stem table TA extends by a profiled lug, or spoiler, BE, in the extension of which the second face 3 is found when the deflector member 1 occupies its idle position.

Figure 11:
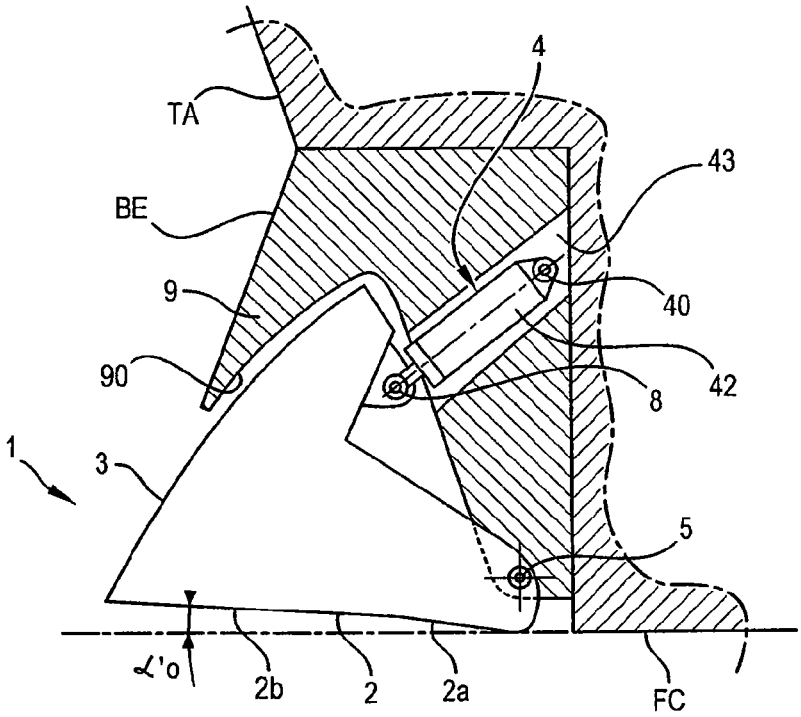
FIGS. 11 and 12 are views similar to those of FIGS. 9 and 10, respectively, showing a third embodiment of the device.
Figure 12:
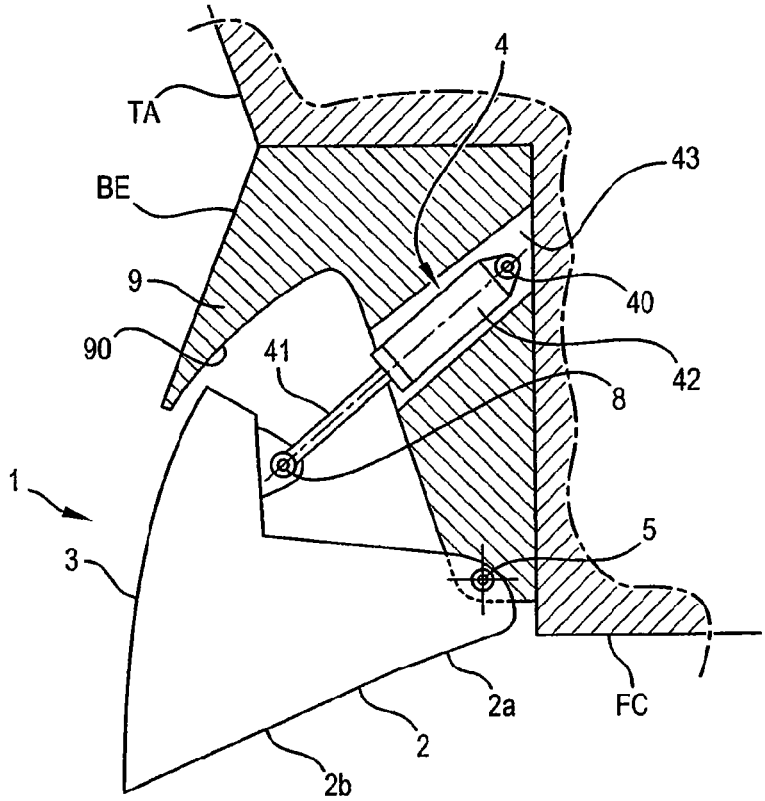

The deflector 1 of FIGS. 11 and 12 has a first face 2 made up of two front 2*a* and rear 2*b* contiguous facets forming an obtuse angle dihedron, open toward the bottom; the second face 3 is curved, substantially in the shape of a cylinder arc centered on the shaft 5, with a convexity facing the rear.

When this deflector member 1 occupies its idle position shown in FIG. 9, the facet 2*b* forms a non-null angle $\alpha'_0$, but which is negative, in relation to the plane of the hull bottom FC.

This angle becomes positive and increases according to the extension of the jacks 4 (see FIG. 12).

In this embodiment, the base of the stem table TA is also extended by a profiled spoiler BE; the latter part here takes the shape of a protective shield 9, inside which the upper portion of the element 1 is housed in the idle position. To this end, this shield 9 has a concave profiled inner face 90, the curve of which is adapted to that of the second face 3.

This shield 9 protects the deflector member 1 and the jacks 4 from the assault of the surge and waves from the rear.

In the various embodiments just described, in connection with FIGS. 9 to 12, one will note that the jacks 4 are also housed in a protective case 43.

It should be noted that, in the case where the ship is equipped with a set of deflector cases, lowering the side cases makes it possible to obtain a beneficial anti-rolling effect.

Traditionally, a ship of this type is equipped with effective anti-rolling stabilizing boards. However, these boards having a relatively significant drag, which offers resistance to the forward motion of the ship.

In case of calm sea, it may be interesting to retract these boards, and lower the side deflector cases, which may perform the anti-rolling function in their place, but with a reduced resistance to forward motion; indeed, the incline of the cases mainly causes a lift, with little drag.

Of course, in case of rough sea, generating significant rolling, the boards continue to be activated, either alone or together with the side deflectors.

We claim:

1. A ship, with a displacement speed between 10 and 25 knots or a cruising speed between 18 and 45 km/h and a Foude number which does not exceed 0.28, a stern of which is equipped with a device for deflecting flows of water, comprising several deflector members (1) having a submerged lower face (2), called first face, fitting overall into an extension of the hull bottom (FC), toward the rear thereof, while forming an angle ($\alpha$) in relation to a general plane ($\Delta$) tangent to this bottom (FC), each of these deflector members (1) being articulated to the hull, control means making it possible to cause it to pivot in one direction or the other in order to cause said angle ($\alpha$) to vary, characterized by the fact that, on one hand, these deflector members (1) are similar and juxtaposed such that they extend transversely side by side, over all, or nearly all, the width of the stern, each of them consisting of a case with a rear face or second face (3), also at least partially submerged, able to be lowered by increasing said angle ($\alpha$), so as to form an approximately vertical wall opposing slamming by rear surge, and that, on the other hand, said means for controlling the pivoting of each deflector member (1) comprise at least one hydraulic jack (4), the body (42) of which is housed in a protective case (43) integral with the structure of the hull and the rod (41) of which is inserted between the rear portion of the hull and the case (1) for which it controls the pivoting, such that this jack is sheltered from the surge and waves.

2. The ship according to claim 1, characterized by the fact that each case (1) is closed on top by walls (6, 7) turned upward and frontward, respectively, forming a dihedron, and is closed on its sides by lateral vertical walls, said hydraulic jack being inserted between the stern structure of the ship and an angular zone of this dihedron, such that it is isolated in a relatively enclosed space in the upper portion of the dihedron.

3. The ship according to claim 1, characterized by the fact that said control means make it possible to vary said angle ($\alpha$) in a range between a negative value, corresponding to an orientation of said first face (2) inclined upward and rearward in relation to said general plane ($\Delta$), and a positive value, corresponding to an orientation of this first face (2) inclined downward and rearward in relation to this general plane ($\Delta$).

4. The ship according to claim 2, characterized by the fact that said control means make it possible to vary said angle ($\alpha$) in a range between a negative value, corresponding to an orientation of said first face (2) inclined upward and rearward in relation to said general plane ($\Delta$), and a positive value, corresponding to an orientation of this first face (2) inclined downward and rearward in relation to this general plane ($\Delta$).

5. The ship according to one of the preceding claims, characterized by the fact that said control means comprise a set of hydraulic jacks (4) working synchronously.

6. The ship according to claim 5, characterized by the fact that said hydraulic jacks (4) are voluntarily controlled by actuating a maneuvering member.

7. The ship according to claim 5, characterized by the fact that said hydraulic jacks (4) are controlled by a shuttle valve, subjugated to the speed and/or trim of the ship.

8. The ship according to claim 1, characterized by the fact that said first face (2) is substantially flat.

9. The ship according to claim 1, characterized by the fact that said first face (2) is made up of two substantially flat front (2*a*) and rear (2*b*) facets which form an obtuse angle dihedron open downwardly.

10. The ship according to claim 1, characterized by the fact that said second face (3) is substantially flat.

11. The ship according to claim 1, characterized by the fact that said second face (3) is made up of two substantially flat upper (3*a*) and lower (3*b*) facets which form an obtuse angle dihedron open toward the rear.

12. The ship according to claim 1, characterized by the fact that the set of deflector members (1) has a shared pivot axis (W1-W2).

13. The ship according to claim 1 or claim 12, characterized by the fact that the pivoting of all of the deflector members (1) is done jointly, over a same angle (α), using said pivot control means.

14. The ship according to claim 1 or claim 12, characterized by the fact that the pivoting of the different deflector members (1) is done in a differentiated manner, with different angle (α) values, using said pivot control means.

15. The ship according to claim 1, characterized by the fact that its stern is provided with a spoiler (BE) serving as a shield (9) able to protect the deflector member (1) as well as the hydraulic jacks (4) from the assault of the surge and waves coming from the rear.

16. A ship, with a displacement speed between 10 and 25 knots or a cruising speed between 18 and 45 km/h and a Foude number which does not exceed 0.28, a stern of which is equipped with a device for deflecting flows of water, comprising several deflector members (1) having a submerged lower face (2), called first face, fitting overall into an extension of the hull bottom (FC), toward the rear thereof, while forming an angle (α) in relation to a general plane (Δ) tangent to this bottom (FC), each of these deflector members (1) being articulated to the hull, control means making it possible to cause it to pivot in one direction or the other in order to cause said angle (α) to vary, characterized by the fact that, on one hand, these deflector members (1) are similar and juxtaposed such that they extend transversely side by side, over all, or nearly all, the width of the stern, each of them consisting of a case, and that, on the other hand, said means for controlling the pivoting of each deflector member (1) comprise at least one hydraulic jack (4), the body (42) of which is housed in a protective case (43) integral with the structure of the hull and the rod (41) of which is inserted between the rear portion of the hull and the case (1) for which it controls the pivoting, such that this jack is sheltered from the surge and waves, wherein said first face (2) is made up of two substantially flat front (2*a*) and rear (2*b*) facets which form an obtuse angle dihedron open downwardly.

17. A ship, with a displacement speed between 10 and 25 knots or a cruising speed between 18 and 45 km/h and a Foude number which does not exceed 0.28, a stern of which is equipped with a device for deflecting flows of water, comprising several deflector members (1) having a submerged lower face (2), called first face, fitting overall into an extension of the hull bottom (FC), toward the rear thereof, while forming an angle (α) in relation to a general plane (Δ) tangent to this bottom (FC), each of these deflector members (1) being articulated to the hull, control means making it possible to cause it to pivot in one direction or the other in order to cause said angle (α) to vary, characterized by the fact that, on one hand, these deflector members (1) are similar and juxtaposed such that they extend transversely side by side, over all, or nearly all, the width of the stern, each of them consisting of a case, and that, on the other hand, said means for controlling the pivoting of each deflector member (1) comprise at least one hydraulic jack (4), the body (42) of which is housed in a protective case (43) integral with the structure of the hull and the rod (41) of which is inserted between the rear portion of the hull and the case (1) for which it controls the pivoting, such that this jack is sheltered from the surge and waves, wherein the stern is provided with a spoiler (BE) serving as a shield (9) able to protect the deflector member (1) as well as the hydraulic jacks (4) from the assault of the surge and waves coming from the rear.

* * * * *